US006575165B1

(12) United States Patent
Cook et al.

(10) Patent No.: US 6,575,165 B1
(45) Date of Patent: Jun. 10, 2003

(54) APPARATUS AND METHOD FOR BREATHING APPARATUS COMPONENT COUPLING

(75) Inventors: David Cook, Bracknell (GB); Raymond Odell, Brookmans Park (GB); Ian T. Petherbridge, Bognor Regis (GB); Pierre Legare, Addison (CA); Robert P. Lapointe, Nepean (CA); Kenneth J. Krepel, North St. Paul, MN (US); David M. Blomberg, Lino Lakes, MN (US); Derek S. Baker, Lake Elmo, MN (US); James R. Betz, Hudson, WI (US); Thomas I. Insley, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 46 days.

(21) Appl. No.: 09/632,142

(22) Filed: Aug. 3, 2000

(51) Int. Cl.[7] ..... A62B 18/08; A62B 19/00

(52) U.S. Cl. ..... 128/206.17; 128/205.12; 128/205.27; 128/205.29

(58) Field of Search ..... 128/205.12, 205.27, 128/205.29, 206.17, 201.25, 205.25, 204.12, 898; 403/362; 55/DIG. 33, DIG. 35

(56) References Cited

U.S. PATENT DOCUMENTS

| | | | | | |
|---|---|---|---|---|---|
| 2,642,061 | A | | 6/1953 | Boyer | |
| 3,711,138 | A | | 1/1973 | Davis | |
| 3,977,432 | A | * | 8/1976 | Vidal | 128/205.11 |
| 4,088,461 | A | | 5/1978 | Brauer | |
| 4,678,572 | A | * | 7/1987 | Hehl | 210/150 |
| 4,850,346 | A | | 7/1989 | Michel et al. | |
| 4,932,399 | A | * | 6/1990 | Cappa et al. | 128/202.27 |
| 4,971,052 | A | | 11/1990 | Edwards | |
| 5,035,239 | A | | 7/1991 | Edwards | |
| 5,036,844 | A | | 8/1991 | Pouchot et al. | |
| 5,125,402 | A | | 6/1992 | Greenough | |
| 5,303,701 | A | | 4/1994 | Heins et al. | |
| 5,372,130 | A | * | 12/1994 | Stern et al. | 128/205.25 |
| 5,579,761 | A | * | 12/1996 | Yuschak et al. | 128/201.25 |
| 5,676,133 | A | * | 10/1997 | Hickle et al. | 128/202.27 |
| 5,788,215 | A | * | 8/1998 | Ryan | 251/149.6 |
| 5,906,203 | A | | 5/1999 | Klockseth et al. | |
| 5,924,420 | A | * | 7/1999 | Reischel et al. | 128/206.17 |
| 6,016,804 | A | * | 1/2000 | Gleason et al. | 128/205.25 |

FOREIGN PATENT DOCUMENTS

| | | |
|---|---|---|
| EP | 0 108 560 | 10/1983 |
| EP | 0 164 946 | 5/1985 |
| EP | 0 225 744 | 11/1986 |
| EP | 0 310 970 | 4/1989 |
| EP | 0 349 191 B1 | 6/1989 |
| EP | 0 352 938 B1 | 7/1989 |
| EP | 0 352 113 | 1/1990 |
| EP | 0 621 056 | 10/1994 |
| GB | 2 071 518 A | 3/1980 |
| WO | WO 83/00632 | 8/1981 |
| WO | WO 96/29116 | 3/1995 |

OTHER PUBLICATIONS

PCT International Search Report dated Jul. 30, 2001.

(List continued on next page.)

*Primary Examiner*—Weilun Lo
*Assistant Examiner*—Michael Mendoza
(74) *Attorney, Agent, or Firm*—Karl G. Hanson; James L. Young

(57) ABSTRACT

The present invention relates to a fan-forced positive pressure breathing apparatus commonly known as a Powered Air Purifying Respirators (PAPR) system, and specifically concerns the connecting of the breathing components of such equipment. The invention is a method and apparatus for rapid engagement of PAPR breathing components (such as air supply lines and filter elements to a blower housing). The invention also provides for indicating and/or monitoring whether the relative components have been aligned and coupled in sealed engagement.

38 Claims, 6 Drawing Sheets

OTHER PUBLICATIONS

Domestic Preparedness—Powered Air Protection for First Responders C420 MIL–SPEC PAPR; Scott A Scott Technologies Company (4 page brochure) (dated 9/99).
U.S. Design Ser. No. 29/127,310, Petherbridge et al., filed Aug. 3, 2000.
U.S. Design Ser. No. 29/127,308, Wolf et al. al, filed Aug. 3, 2000.
U.S. Design Ser. No. 29/127,317, Petherbridge et al, filed Aug. 3, 2000.
U.S. Design Ser. No. 29/127,314, Legare, filed Aug. 3, 2000.
U.S. Design Ser. No. 29/127,309, Petherbridge et al., filed Aug. 3, 2000.
U.S. Design Ser. No. 29/127,370, Petherbridge et al., filed Aug. 3, 2000.
U.S. Design Ser. No. 29/127,371, Petherbridge et al., filed Aug. 3, 2000.
U.S. Design Ser. No. 29/127,312, Petherbridge et al., filed Aug. 3, 2000.
U.S. Design Ser. No. 29/127,323, Allen et al., filed Aug. 3, 2000.
U.S. Design Ser. No. 29/127,311, Petherbridge et al., filed Aug. 3, 2000.
U.S. Design Ser. No. 29/127,313, Krepel et al., filed Aug. 3, 2000.

* cited by examiner

APPARATUS AND METHOD FOR BREATHING APPARATUS COMPONENT COUPLING

BACKGROUND OF THE INVENTION

The present invention relates to fan-forced positive pressure breathing apparatus, commonly known as Powered Air Purifying Respirators (PAPRs). In particular, the invention concerns rapid engagement mounting systems for affixing breathing components to the blower housing of the PAPR. Breathing components might include filter elements, hose attachments for supplied air, or other components required to complete a breathing circuit. Rapid engagement mounting systems are generally defined as reversible attachments that allow the deployment of a breathing component by pressure fit, sliding engagement, or rotational locking with less than one full revolution of the component.

Non-powered air purifying respirator equipment involves a breathing mask having a filtered air inlet. Air is drawn through the filter by means of the wearer's breathing action. When the wearer draws a breath, negative pressure is created in the mask and air is drawn though the filtering element. When the wearer expels a breath, spent air leaves the mask through a valve. PAPRs are employed to continually supply positive pressure to the wearer's mask. The filtered supplied air replenishes the internal confines of the mask and is continually ejected. To provide ease of replacement of the filter elements on non-powered respirators, bayonet type of attachments are often employed. These attachments require less than one full turn of the filter to engage the cartridge to the respirator body.

PAPRs are generally used in industrial applications where the environmental hazards are well defined and quantified. Respiratory hazards might include harmful gases, vapors, and particulate matter. To address generally known and quantified industrial hazards, a PAPR can be configured well in advance of entry into the workplace, and the amount of time a worker spends in a hazardous environment can also be well managed. In industrial settings, PAPR systems that employ multiple-turn screw type attachments for connecting the breathing components require more effort and time to properly affix.

First responders (HazMat, police, fire, and civil defense), military or other emergency response units are not afforded the opportunity to preemptively manage hazardous respiratory exposure. Depending on the nature of the exposure, the responder must quickly configure the respiratory system to adapt to the need. Exposure duration and levels are also unknown transients in the protection equation. In certain situations, the responder may not be able to extract themselves from the exposure arena and could be required to make a 'hot' change-out of the PAPR breathing components. An example of this situation might be found in a military theater where the user could be required to replenish filters while remaining in the exposed area.

BRIEF SUMMARY OF THE INVENTION

The present invention relates to Powered Air Purifying Respirators (PAPRs) that incorporate breathing components adapted for rapid engagement with the blower housing of the system. In a preferred embodiment, the invention further provides for engagement detection elements that indicate the proper engagement of the breathing component to the PAPR housing. Rapid engagement breathing components combined with engagement detection elements, afford superior wearer protection in situations where a PAPR is required to be quickly configured to a respiratory hazard or when 'hot' change-outs of the breathing components are desired. The inclusion of engagement detection elements on a PAPR system provides any user with a higher level of system integrity regardless of the application.

PAPR systems of the present invention differ from known PAPRs in two basic aspects that involve both the attachment and detection system. Known PAPR systems employ screw-type attachments to affix filters to the blower housing. These screw-type attachments are multiple-turn in nature and do not lend themselves to rapid engagement of a filter. Multi-turn screw systems are also susceptible to cross threading if care is not taken with their attachment. Rapid engagement attachment systems are particularly suited to rapid configuration and deployment of PAPR systems, especially in first-responder or military situations.

Rapid engagement attachments require a minimum, if any, rotation of the breathing component by using highly pitched threads to connect the filter cartridge to the blower housing. In addition, the rapid engagement connection releasably locks the filter cartridge to the blower by using opposing detents to form a seated engagement between the blower housing and filter cartridge. This prevents the filter cartridge from accidentally disconnecting from the blower housing.

Attachment systems of known PAPRs also do not employ engagement detection elements. The only indication of proper engagement of the filter to the housing is the resistance to turning that could be misinterpreted if the filter was cross-threaded. The engagement detection system of the present invention provides a definitive indicator of attachment, both at the point of fixing and during use of the system. Engagement detection systems of the invention are especially useful in fail-safe and 'hot' change out applications, where actions of the blower motor or flow damper components can be actuated as a function of component engagement.

The engagement detection system of the invention may employ electrical, mechanical or optical contacts. As part of a circuit, an electrical or optical contact between the breathing component and the PAPR body is operably coupled to an auditory or visual signal to indicate proper seated and sealed engagement of the components. This type of arrangement could also be used, for instance, to actuate dampers to reverse air flow through the blower housing causing air to exhaust in order to enable 'hot' change-outs of the breathing component. In addition or optionally, a mechanical contact could provide an auditory or tactile indication of proper contact and could also incorporate a disengagement fail-safe to prevent the breathing component from reversing off its attachment.

BRIEF DESCRIPTION OF THE DRAWINGS

The present invention will be further explained with reference to the attached figures, wherein like structure is referred to by like numerals throughout the several views.

While the above-identified drawing figures set forth one preferred embodiment of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
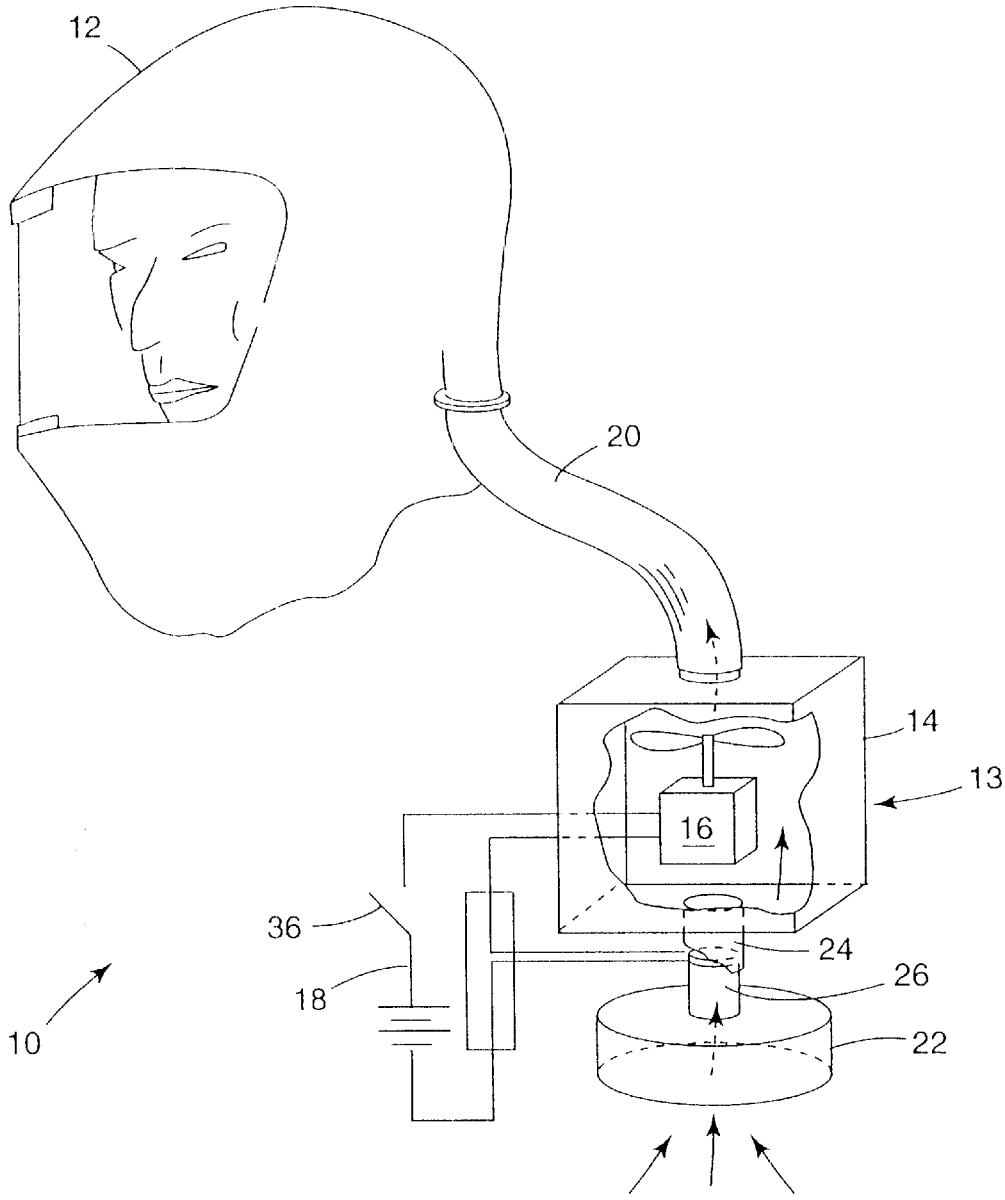
FIG. 1 is a perspective and diagramic view of a Powered Air Purifying Respirator (PAPR) system.

The main components of a Powered Air Purifying Respirator (PAPR) system 10 are shown in FIG. 1. PAPR 10 includes breathing head-gear 12 and a connected remote fan and filter unit 13, resulting in a fan-forced positive pressure breathing apparatus. PAPR 10 is designed to be worn by a person working in an atmosphere with unwanted contaminants. PAPR 10 filters unwanted contaminants from the surrounding atmosphere, thus allowing a person wearing PAPR 10 to work in the contaminated area. The filter used with PAPR 10 becomes full of contaminants over time and must be replaced.

The present invention focuses on the replacement of filters by providing a rapid engagement connection between a main housing and a replaceable filter cartridge of PAPR 10. The rapid engagement connection may also be used with other breathing components attached to the housing of PAPR 10, such as air hoses and pressurized-air-supply adapters. In a preferred embodiment, the present invention also incorporates an engagement detection system that signals the user when the filter cartridge and housing (or other coupled breathing components) are properly engaged.

PAPR 10, shown in FIG. 1, includes a blower housing 14, a blower 16, a power source 18, a breathing tube 20, one or more replaceable filter cartridges, canisters or other filter units 22, a housing-fluid (air) inlet 24, and a filter-fluid (air) outlet 26. Blower housing 14 contains blower 16, which is driven by power source 18. Blower 16 is used to create a negative pressure in a chamber within housing 14, which draws air through filter cartridge 22. The air is filtered and then delivered to a user wearing head-gear 12 via breathing tube 20. Filter-fluid outlet 26 (on the filter cartridge 22) attaches to housing-fluid inlet 24 (on the blower housing 14), which allows filter cartridge 22 to be periodically replaced.

Figure 2:
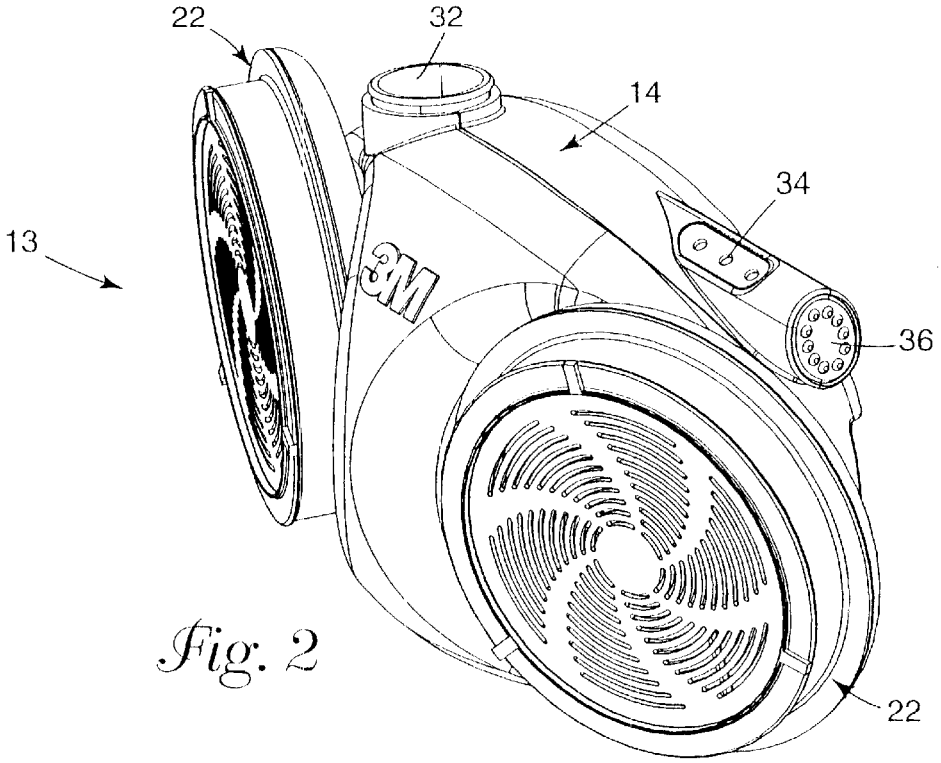
FIG. 2 is a perspective view of a preferred embodiment of the fan and filter assembly of the PAPR.
Figure 3:
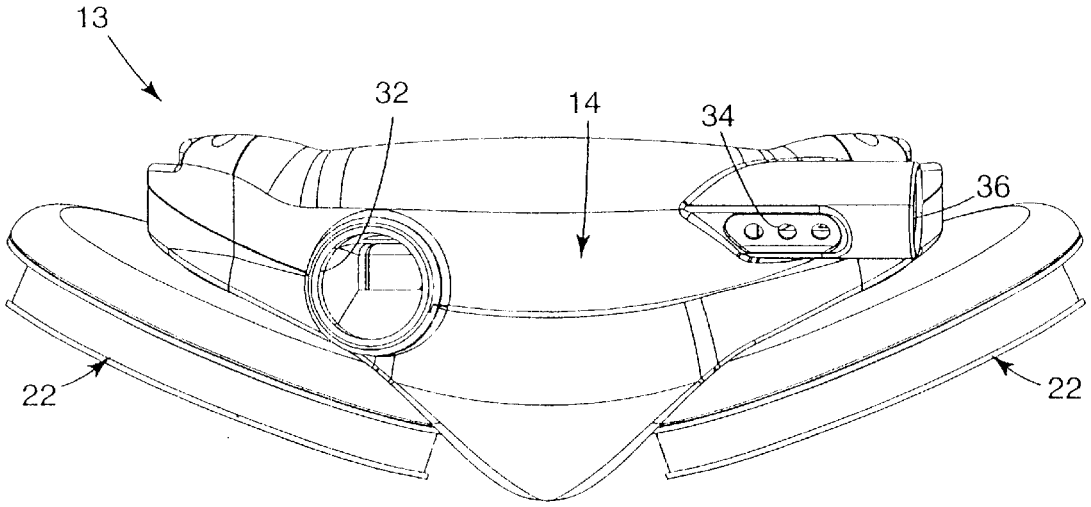
FIG. 3 is a top view of the preferred embodiment of the fan and filter assembly of the PAPR.
Figure 4:
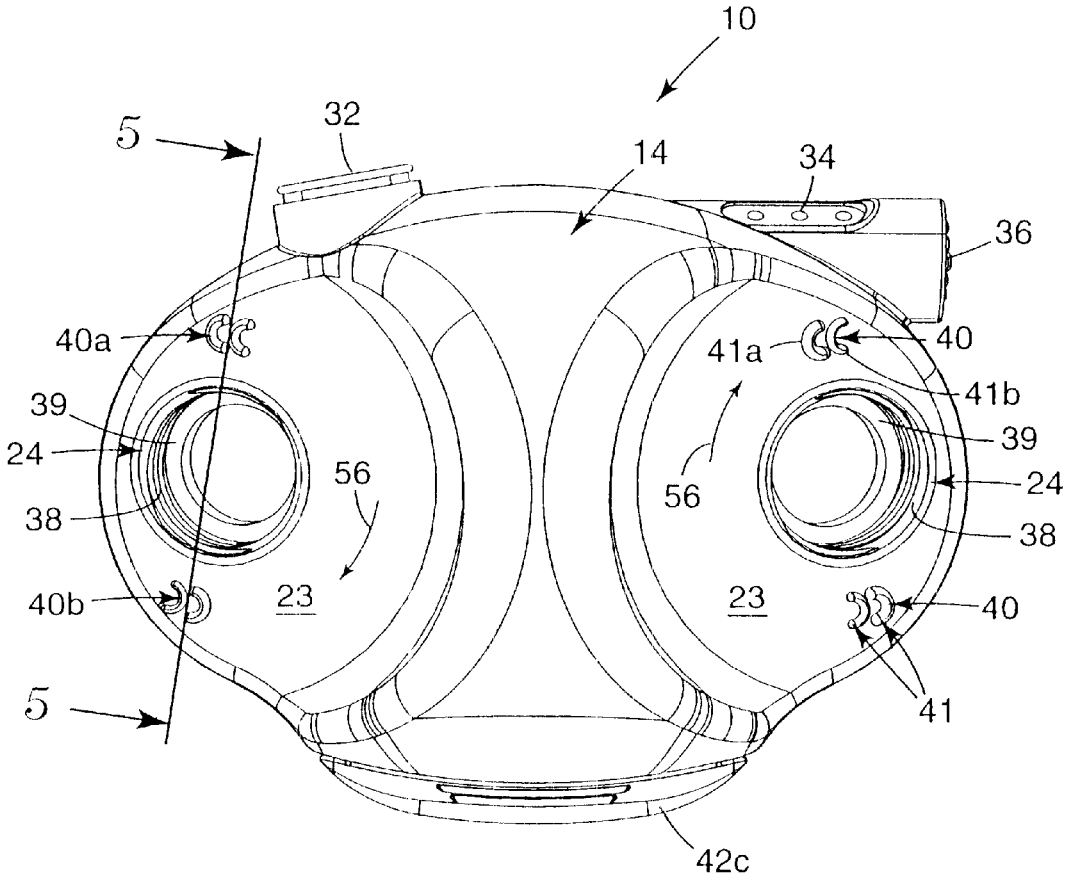
FIG. 4 is a front view of the preferred embodiment of the fan and motor housing of the PAPR.
Figure 5:
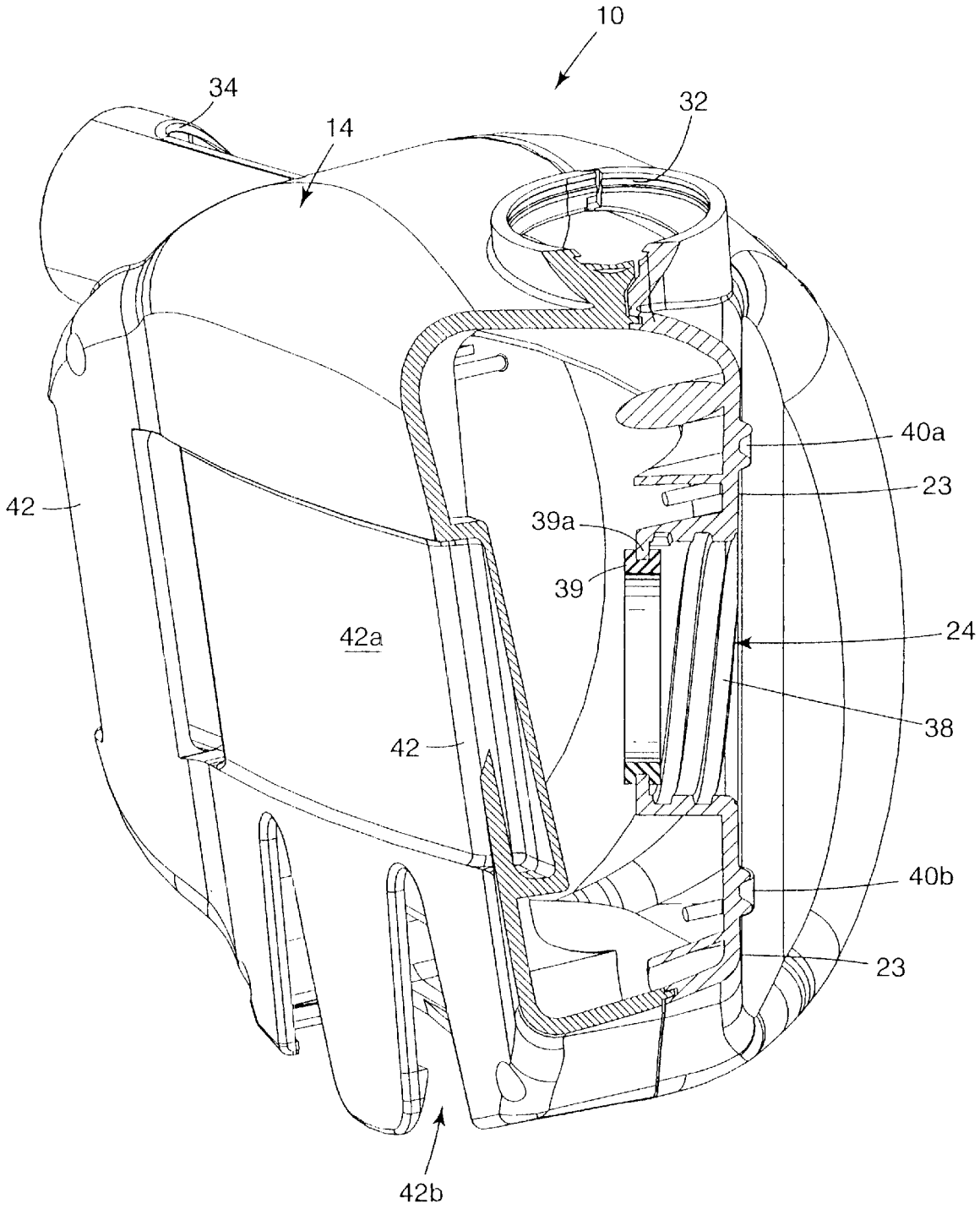
FIG. 5 is a sectional view as taken along line 5—5 of FIG. 4.

FIGS. 2–8 show a preferred embodiment of components of PAPR 10. FIG. 2 provides a perspective view of the fan and filter unit 13 of PAPR 10, while FIGS. 3 and 4 provide top and front views, respectively (in FIG. 4, the filter cartridges 22 are removed for clarity of illustration). FIG. 5 provides a sectional view of the housing 14 of PAPR 10 taken from line 5—5 of FIG. 4. The preferred embodiment of PAPR 10 shown in FIGS. 2–5 includes a blower housing 14 and a pair of filter cartridges 22 attached thereto. The housing 14 and each filter cartridge 22 are conduits which are coupled together to facilitate the flow of fluid (in this case, filtered air). FIGS. 2–4 specifically show two filter cartridges 22 attached to blower housing 14, however, the present invention is not limited by the number of filter cartridge 22 used with blower housing 14. One filter cartridge may suffice (see, e.g., FIG. 1), or more than two filter cartridges 22 may be used, as desired for a particular filtering application.

In addition to the plurality of filter cartridge 22, shown in FIGS. 2–3 and explained in further detail below, the housing 14 of PAPR 10 includes breathing tube connection 32, engagement detection indicator 34, and power switch 36 (such as, for example, a recessed push-button switch). Breathing tube connection 32 is the connection between the housing 14 of PAPR 10 and breathing head-gear 12. Breathing tube connection 32 may also incorporate a rapid engagement system of the present invention, however, the preferred embodiment shown in FIGS. 2–4 has the rapid engagement system only between the filter cartridges 22 and the blower housing 14.

The engagement detection system of the present invention is explained in further detail below, but its purpose is to provide a person wearing PAPR 10 with an affirmative indication that the breathing system components are properly connected. Power switch 36 allows the user to turn PAPR 10 on and off. When PAPR 10 is turned on, the switch of power source 18, shown in FIG. 1, is closed; thus, blower 16 is powered.

FIG. 4 shows the housing 14 of PAPR 10 with filter cartridges 22 removed, thus revealing (for each filter cartridge 22) filter mounting surface 23, housing-fluid inlet 24 (having housing-fluid-inlet threads 38) and housing detents 40 (40*a*, 40*b*) thereon. While the preferred embodiment of housing 14 incorporates a pair of housing detents 40 on filter mounting surface 23, the present invention may include one or more than two detents, and is not limited by the number of housing detents 40 formed on blower housing 14. In a preferred embodiment, as shown, detents 40*a* and 40*b* are radially aligned on opposite sides of each housing-fluid inlet 24 on housing 14.

The preferred embodiment of PAPR 10 contains two housing-fluid inlets 24. Each housing-fluid inlet 24 is located on opposite sides of the front of housing 14 and is designed to sealably couple to one of the filter cartridges 22. Housing-fluid inlet 24 protrudes axially into housing 14 from its respective filter mounting surface 23, such that it can accommodate filter-fluid outlet 26 of its respective filter cartridge 22. Housing-fluid inlet 24 has housing-fluid-inlet threads 38 formed therein (see FIG. 5). A deformable gasket 39 is mounted on the housing-fluid inlet 24 at an inner end 39*a* thereof.

Figure 6:
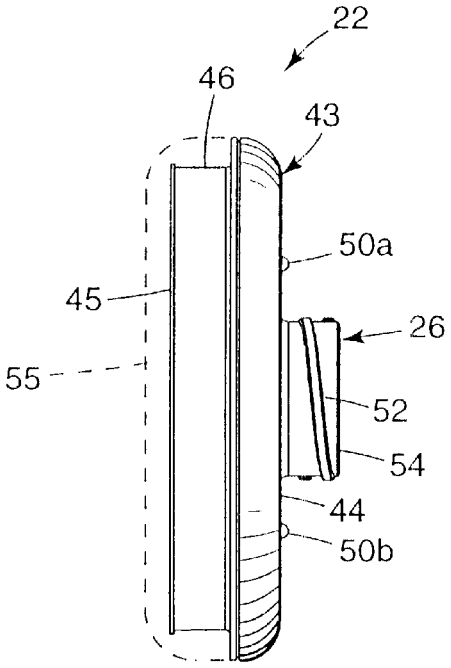
FIG. 6 is a side view of one of the filter cartridges of the preferred embodiment of the PAPR.
Figure 7:
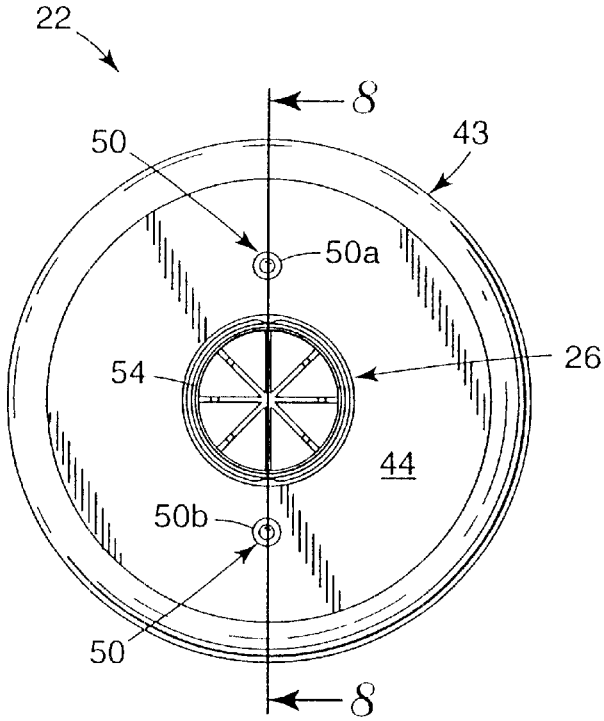
FIG. 7 is a bottom view of the filter cartridge of FIG. 6.
Figure 8:
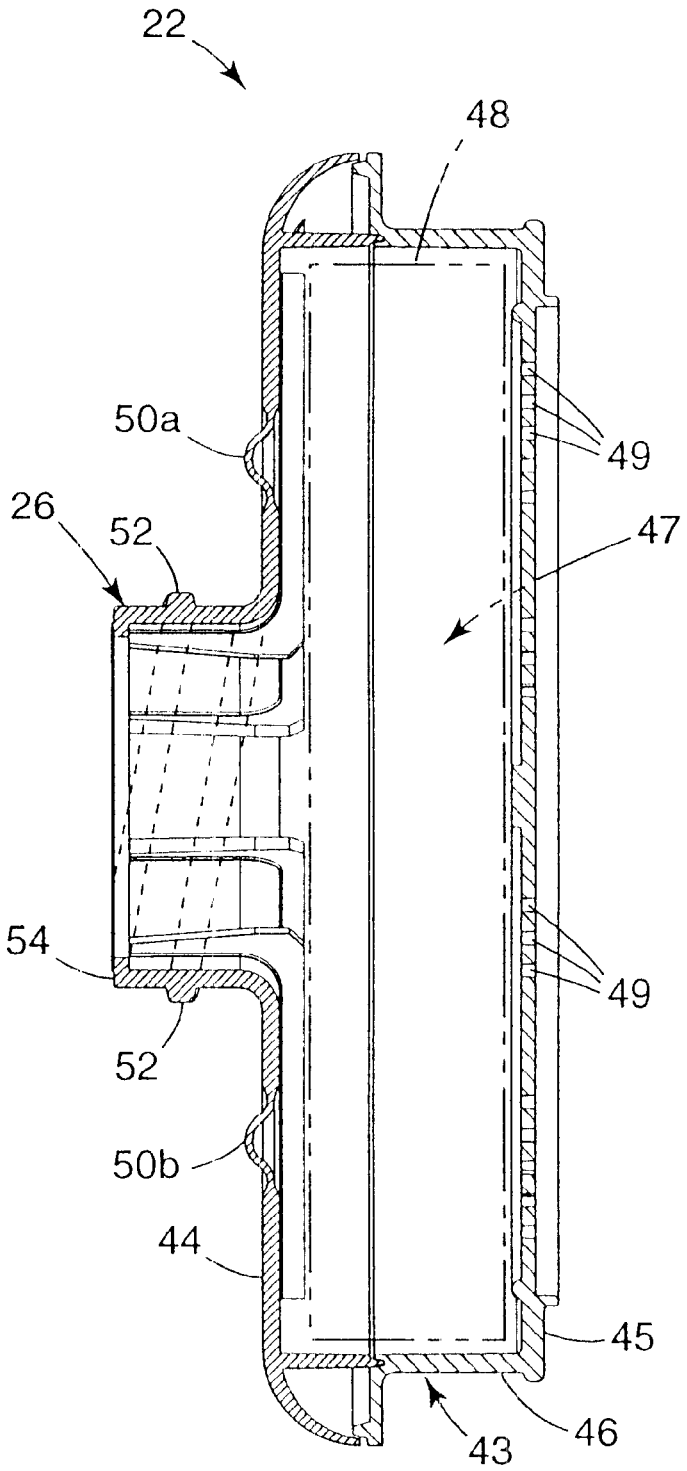
FIG. 8 is a sectional view as taken along line 8—8 of FIG. 7.

Preferably, housing-fluid-inlet threads 38 are female threads, defined on the inside surface of housing-fluid inlet 24 and are designed to mate with male threads of filter-fluid-outlet threads 52 on filter cartridges 22, as shown in FIGS. 6–8 and described below. Each of the housing-fluid-inlet threads 38 is highly pitched and extends only about once around the inner circumference of housing-fluid inlet 24. The threads, for example, may have a pitch of 0.220 inch, and may be formed as stub acme threads.

Housing detents 40 (40*a*, 40*b*) are spaced radially from the axis of housing-fluid inlet 24. Preferably, each housing detent 40 is formed in the shape of an arc 41 that protrudes from the filter mounting surface 23 of housing 14 (compare FIGS. 4 and 5). Housing detents 40 align with filter detents 50 on the filter cartridge 22 along an engagement axis parallel with the rotational axis of the relative components, as shown in FIGS. 6–8 and described below, such that housing detents 40 engage and releasably lock filter detents 50 when the filter cartridge 22 is sealably mounted on housing 14.

In addition to the components of PAPR 10 shown in FIGS. 2–4 and described above, belt harnesses 42 are shown in FIG. 5. Belt harnesses 42 allow a user to attach the housing 14 of PAPR 10 to a belt, by sliding a belt through a belt track 42*a*, defined on the back of housing 14. The housing 14 may also have a compartment 42*b* (see FIG. 5) for receiving and retaining a battery pack 42*c* therein (see FIG. 4).

FIGS. 6–8 show the details of filter cartridge 22. FIGS. 6 and 7 show side and bottom views of filter cartridge 22, respectively, while FIG. 8 is a sectional view of filter cartridge 22 taken along line 8—8 of FIG. 7. Each filter cartridge 22 has a filter housing 43 having a bottom surface 44, an opposed top surface 45, and a generally cylindrical side wall 46 connecting the bottom and top surfaces 44 and 45. Filter media 47 (shown in dashed line in FIG. 8) is retained within an internal chamber 48 defined by filter housing 43, with the chamber 48 in fluid communication with the filter-fluid outlet 26 and with the exterior of the filter housing 43 via a plurality of perforations 49 in the top surface 45. As noted above, filter cartridge 22 of the embodiment shown in FIGS. 6–8 includes a plurality of filter detents 50 (50*a*, 50*b*), thereon. However, the present invention may include only one or more than two filter detent 50 and is not limited by the number of filter detents 50 formed on filter cartridges 22.

As shown in FIG. 7, the bottom surface 44 of filter housing 43 is preferably circular and includes filter-fluid outlet 26 and filter detents 50 thereon. Filter-fluid outlet 26 is located in the center of bottom surface 44 of filter housing 43. Filter-fluid outlet 26 protrudes axially from bottom surface 44, as shown in FIG. 6.

Filter-fluid-outlet threads 52, as shown in FIGS. 6 and 8, are located on the outside surface of filter-fluid outlet 26. Filter-fluid-outlet threads 52 are male threads and are formed to mate with the female housing-fluid-inlet threads 38. Filter-fluid-outlet threads 52 are highly pitched and extend over only half the of the outer circumference of filter-fluid outlet 26; thus, less than a single rotation (i.e., less than one full revolution) of the filter cartridge 22 is required to sealably attach filter cartridge 22 to blower housing 14. When so attached, an outer end 54 of the filter-fluid outlet 26 affirmatively engages and deforms the gasket 39 to effect an air-tight seal between the interiors of the filter cartridge 22 and the housing 14.

Filter detents 50, shown in FIGS. 6–8, are located on the bottom surface 44 of filter housing 43, and are spaced radially from filter-fluid outlet 26 and project from the bottom surface 44. Filter detent 50*a* aligns with housing detent 40*a*, shown in FIG. 4, such that when filter-fluid outlet 26 is threadably attached to housing-fluid inlet 24, filter detent 50*a* engages with and seats into housing detent 40*a*. The opposed detents of filter detent 50*a* and housing detent 40*a* thus create a male/female seated engagement that sealably secures filter cartridge 22 to blower housing 14. Filter detent 50*b* and housing detent 40*b* are likewise shaped to form a seated engagement between filter cartridge 22 and blower housing 14 when the cartridge 22 and housing 14 are sealably and threadably coupled together.

During normal use of PAPR 10, blower housing 14 and filter cartridge 22 are bumped, dropped and can otherwise be subjected to accidental disengagement. In addition, filter cartridge 22 must be quickly attached to blower housing 14 and simultaneously provide compression to the gasket 39 to create seal integrity. Therefore, filter-fluid outlet 26 attaches to housing-fluid inlet 24 using a rapid engagement connection.

Filter-fluid outlet 26, shown in FIG. 6, axially aligns with housing-fluid inlet 24, shown in FIG. 4. As explained above, housing-fluid inlet 24 and filter-fluid outlet 26 contain highly pitched threads that are designed for a quick connection between blower housing 14 and filter cartridge 22. Filter-fluid outlet 26 is fully coupled to housing-fluid inlet 24 with less than a single rotation of filter cartridge 22 relative to blower housing 14 (e.g., by relative rotation of less than 360°). This rapid connection sealably connects filter cartridge 22 to blower housing 14 for filtered air passage therebetween. The rapid engagement connection between blower housing 14 and filter cartridge 22, disclosed and shown herein, can likewise be used to attach other breathing components of the PAPR 10, or of other breathing systems. In addition, while the disclosed preferred embodiment shows "male" threads on the filter-fluid outlet 26 and "female" threads on the housing-fluid inlet 24, that relationship may be reversed.

The rapid engagement threads of housing-fluid inlet 26 and filter-fluid outlet 24 are complimented with a click-lock feature that serves multiple purposes. One purpose of the click-lock feature is to provide resistance to accidental disengagement of filter cartridge 22 from blower housing 14. Another purpose is to identify to the user that the seal has been properly made, thus ensuring proper installation.

The click-lock feature incorporates housing detents 40, shown in FIG. 4, and filter detents 50, shown in FIGS. 6–8. Filter detents 50 and housing detents 40 comprise a pair of opposed detents that are aligned axially, radially, and circumferentially for seated engagement. Filter detents 50 comprise detent elements that are spaced radially from filter-fluid outlet 26, and function as male projecting detent elements. Housing detents 40 comprise detent elements that are spaced radially from housing-fluid inlet 24 and function as female receptive detent elements, such that they align with filter detents 50 to make seated engagement connections when filter-fluid outlet 26 and housing-fluid inlet 24 are threadably coupled. The seated engagement connection forms an interference fit that releasably locks blower housing 14 and filter cartridge 22 together, to lessen the possibility of filter cartridge 22 becoming inadvertently disconnected from blower housing 14. This type of seated engagement connection can also be used to attach together other accessory components of PAPR 10 or other breathing systems. In addition, while the disclosed preferred embodiment shows a "male" detent element on the filter cartridge 22 and a "female" detent element on the blower housing, that relationship may be reversed. The terms "detent" and "detent element" as used herein mean any form of structural feature that cooperates with an opposed mating structural feature to achieve the position detection and component interlocking functions describe herein.

The click-lock feature of the rapid engagement connection also provides the user with an indication of whether the seal between filter cartridge 22 and housing 14 has been properly made, thus ensuring proper installation. The engagement detection system uses a mechanical, electrical, or optical method of detecting when a proper connection is made between filter cartridge 22 and housing 14. An audio, visual, or other signal control mechanism is used show the user when a proper connection had been made.

An example of a mechanical detection system is the audible clicks heard when filter detents 50 slide over housing detents 40 and snaps into place. Both housing 14 and filter cartridge 22 are made of a resilient material such as plastic. The resilient material slightly deforms under force; thus, the housing detent 40 and the filter detent 50 engage by slight deformation of the detents and their respective support surfaces to allow the filter detent 50 to slide over the housing detent 40. After deformation, the detents 40 and 50 snap back to their original shapes. When the filter detent 50 passes over the housing detent 40, there is an audible clicking sound (the filter detent 50 moves in the direction of arrow 56 (FIG. 4) when the filter cartridge 22 is being mounted onto the housing 14). One or more clicks may be heard, depending on the number of housing detent arcs 41 formed on surface 23 of housing 14. For example, if housing 14 contains two detent arcs 41*a* and 41*b,* as shown in FIG. 4, then a user would need to hear two clicks to know that filter cartridge 22 and housing 14 are properly engaged.

Another example of a mechanical detection system is the tactile click felt when a filter detent 50 passes over a housing detent 40. As explained above, the resilient material slightly deforms to allow filter detent 50 to slide over housing detent 40. When housing detent 40 and filter detent 50 come into initial engagement as the filter cartridge 22 is being mounted on the housing 14, a slight pressure and resistance to rotation is felt by the user. As this resistance is overcome, a tactile "snapping" sensation is felt, indicating that the detent components are interlocked. Likewise, when the opposed detents 40 and 50 are in seated engagement (and, therefore, the filter cartridge 22 is then releasably locked to the housing 14), there is resistance to rotation for separating the filter cartridge 22 from the housing 14. A tactile "snap" is felt if that resistance is overcome by placing sufficient rotational force on the filter cartridge 22 to unseat the opposed detents 40 and 50 and initiate threaded uncoupling of the filter cartridge 22 and blower housing 14.

The engagement detection system can also use an electrical signal to indicate a proper connection between filter cartridge 22 and housing 14. The electrical system either provides an audible or visual indication to a user and/or can control the operation of blower 16. The audible or visual indication comes from engagement detection indicator 34, shown in FIGS. 2–4. The engagement detection indicator 34 may provide an audible signal (such as a buzz or a tone) or a visual signal (such as turning a light on or off). The inventive engagement detection system may also incorporate a control signal that operates blower 16 or activates dampers in the PAPR 10 air flow stream.

There are a number of ways to determine if filter cartridge 22 is properly coupled with housing 14. For example, housing surface 23 of housing 14 may contain a pair of electrical contacts. When filter cartridge 22 and housing 14 are uncoupled, the contacts would not be connected and would create an open circuit or open state. The open state would indicate that a proper connection has not been made. Once filter cartridges 22 and housing 14 are properly engaged, the contacts of the circuit would be closed (by, for example, a conductive bridge or connector located on surface 44 of filter cartridge 22). Thus, a closed circuit would exist to indicate a proper connection. Alternatively, the contacts may define a closed circuit, which is then opened upon the seated mounting of the filter cartridge 22 on the housing 14, or the conductivity of the circuit may be altered when the components are engaged in order to define a control signal.

Such a control signal may activate blower 16 or active dampers within the PAPR 10 air flow stream to direct fluid out of housing-fluid inlet 24, redirect fluid into housing-fluid inlet 24, or reverse the flow of fluid (air) in housing-fluid inlet 24. Controlling the flow of air associated with housing-fluid inlet 24 prevents contaminants from getting into the PAPR system while filter cartridge 22 is improperly seated on the housing 14 or while the filter cartridge 22 is being replaced. Other control functions can also occur based on the status of the connection between filter cartridge 22 and housing 14. The engagement detection system enhances user awareness and preparedness for operation in contaminated areas of the PAPR system.

As seen in dashed lines in FIG. 6, a filter cover 55 may be used in some applications (e.g., wet ones) to at least partially shield the perforations 49 and thus prevent premature contamination of the filter media which would shorten filter life and decrease filter effectiveness. In that case, air would enter the filter cartridge 22 from under the cover 55 via openings allowed by the cover 55 along the side wall 46 of the filer cartridge 22.

Although the present invention has been described with reference to preferred embodiments, workers skilled in the art will recognize that changes may be made in form and detail without departing from the spirit and scope of the invention. For example, the inventive coupling may be used to connect a tethered air line to operator-worn breathing components in a non-PAPR system. This would be beneficial in reducing torque placed on such a line during its coupling and uncoupling because relative rotation of the coupled components is minimized.

What is claimed is:

1. A method for mounting a filter cartridge onto a housing in a powered air-purifying respirator (PAPR) system, the method comprising:

axially aligning a fluid outlet on the filter cartridge with a fluid inlet on the housing;

coupling opposed threaded sections on the fluid outlet and the fluid inlet with less than a single turn of the filter cartridge relative to the housing to sealably connect the fluid outlet and the fluid inlet in fluid communication by deforming a gasket therebetween; and releasably locking the filter cartridge to the housing by seated engagement, when the fluid outlet and the fluid inlet are sealably connected, of a pair of opposed detent elements on the filter cartridge and the housing, wherein the opposed detent elements are disposed radially outwardly from the gasket.

2. The method of claim 1 wherein the locking step further comprises:

releasably locking the filter cartridge to the housing by seated engagement, when the fluid outlet and the fluid inlet are sealably connected, of a plurality of pairs of opposed detent elements on the filter cartridge and the housing.

3. The method of claim 1, and further comprising:

detecting whether the fluid outlet is sealably connected to the fluid inlet in fluid communication.

4. The method of claim 3 wherein the detecting step comprises:

rendering an audible signal to a user when the opposed detent elements are in seated engagement.

5. The method of claim 3 wherein the detecting step comprises:

producing a tactile indication to a user when the opposed detent elements are in seated engagement.

6. The method of claim 3 wherein the detecting step comprises:

creating an indicator which is visually detectable to a user when the opposed detent elements are in seated engagement.

7. The method of claim 1 wherein the coupling step comprises:

providing highly pitched threads on the opposed threaded sections on the fluid outlet and the fluid inlet.

8. The method of claim 1 wherein the opposed detent elements of the filter cartridge and housing are on opposed radially extending portions thereof, and further comprising:

forming one of the detent elements as an axially projecting male member; and forming the other detent element as a female reception member which is axially, radially, and circumferentially aligned with the male member when the fluid outlet and the fluid inlet are sealably connected.

9. The method of claim 8 wherein the female reception member is defined as a female detent seat, and further comprising:

forming one or more additional female reception members circumferentially adjacent to the female detent seat.

10. The method of claim 8 wherein the female reception member is a generally radially aligned, arc-shaped detent seat.

11. A method for mounting a filter cartridge onto a housing in a powered air-purifying respirator (PAPR) system, the method comprising:

axially aligning a fluid outlet on the filter cartridge with a fluid inlet on the housing;

coupling the fluid outlet and the fluid inlet with less than a single turn of the filter cartridge relative to the housing to sealably connect the fluid outlet and the fluid inlet in fluid communication;

releasably locking the filter cartridge to the housing by seated engagement, when the fluid outlet and the fluid inlet are sealably connected, of a pair of opposed detent elements on the filter cartridge and the housing; and detecting whether the fluid outlet is sealably connected to the fluid inlet in fluid communication, wherein the detecting step comprises:

altering the conductivity of an electrically conductive circuit when the opposed detent elements are in seated engagement.

12. The method of claim 11, and further comprising:

controlling activation of a fluid transfer motor in the housing, dependent upon the altering step.

13. A method for mounting a filter cartridge onto a housing in a powered air-purifying respirator (PAPR) system, the method comprising:

axially aligning a fluid outlet on the filter cartridge with a fluid inlet on the housing;

coupling the fluid outlet and the fluid inlet with less than a single turn of the filter cartridge relative to the housing to sealably connect the fluid outlet and the fluid inlet in fluid communication;

releasably locking the filter cartridge to the housing by seated engagement, when the fluid outlet and the fluid inlet are sealably connected, of a pair of opposed detent elements on the filter cartridge and the housing; and directing fluid out of the fluid inlet on the housing until the opposed detent elements are in seated engagement.

14. A method for mounting a filter cartridge onto a housing in a powered air-purifying respirator (PAPR) system, the method comprising:

axially aligning a fluid outlet on the filter cartridge with a fluid inlet on the housing;

coupling the fluid outlet and the fluid inlet with less than a single turn of the filter cartridge relative to the housing to sealably connect the fluid outlet and the fluid inlet in fluid communication;

releasably locking the filter cartridge to the housing by seated engagement, when the fluid outlet and the fluid inlet are sealably connected, of a pair of opposed detent elements on the filter cartridge and the housing; and redirecting fluid flow in the housing when the opposed detent elements are placed in seated engagement.

15. The method of claim 14 wherein the redirecting step comprises:

reversing fluid flow through the fluid inlet on the housing when the opposed detent elements are placed in seated engagement.

16. A method for connecting a first component onto a second component for fluid transfer therebetween in a powered air-purifying respirator (PAPR) system, the method comprising:

axially aligning a fluid outlet on the first component with a fluid inlet on the second component;

coupling opposed threaded sections on the fluid outlet and the fluid inlet, by less than a full rotation of the first component relative to the second component to sealably connect the fluid outlet and the fluid inlet in fluid communication; and releasably locking the first component to the second component by seated engagement, when the fluid outlet and the fluid inlet are sealably connected, of a pair of opposed detent elements on the first component and the second component.

17. The method of claim 16 wherein the locking step further comprises:

releasably locking the first component to the second component by seated engagement, when the fluid outlet and the fluid inlet are sealably connected, of a plurality of pairs of opposed detent elements on the first component and the second component.

18. The method of claim 16, and further comprising:

detecting whether the fluid outlet is sealably connected to the fluid inlet in fluid communication.

19. The method of claim 18 wherein the detecting step comprises:

rendering an audible signal to a user when the opposed detent elements are in seated engagement.

20. The method of claim 18 wherein the detecting step comprises:

producing a tactile indication to a user when the opposed detent elements are in seated engagement.

21. The method of claim 18 wherein the detecting step comprises:

creating an indicator which is visually detectable to a user when the opposed detent elements are in seated engagement.

22. The method of claim 16 wherein the coupling step comprises:

providing highly pitched threads on the opposed threaded sections on the fluid outlet and the fluid inlet.

23. The method of claim 16, and further comprising:

redirecting fluid flow through the coupled fluid outlet and fluid inlet once the opposed detent elements have been placed in seated engagement.

24. The method of claim 18 wherein the detecting step comprises:

altering the conductivity of an electrically conductive circuit when the opposed detent elements are in seated engagement.

25. In a fluid flow system having a first fluid conduit and a second fluid conduit, a coupling for connecting the conduits in fluid communication comprising:

a male threaded portion on the first conduit;

a female threaded portion on the second conduit, the male and female portions having cooperating threads for mated engagement along an axis of coupling rotation, and the male and female portions formed so that, by relative conduit rotation of less than 360° in a first direction about the rotation axis, the first and second conduits are affirmative connected;

a first detent element spaced radially from its respective threaded portion and extending in an axial direction on one of the conduits; and a second detent element on the other one of the conduits, the second detent element aligned for seated engagement with the first detent element when the conduits are threadably connected, whereby the seated engagement of the first and second detent elements releasably locks the first and second conduits together.

26. The invention of claim 25, and further comprising:

means for detecting when the first and second detent elements are in seated engagement.

27. The invention of claim 25, and further comprising:

a user-detectible indicator which is activated when the first and second detent elements are placed in seated engagement.

28. The invention of claim 25 wherein the first and second detent elements are formed to render an audible signal to a user when they are placed in seated engagement.

29. The invention of claim 25 wherein the first and second detent elements are formed to produce a tactile indication to a user when they are placed in seated engagement.

30. The invention of claim 25 wherein the first and second threaded portions are highly pitched threaded sections.

31. The invention of claim 25 wherein one of the conduits includes a fluid filtering media therein.

32. The invention of claim 25, and further comprising:

a plurality of opposed pairs of first and second detent elements on the conduits, with the first and second detent elements of each pair formed for respective seated engagement when the conduits are threadably connected.

33. In a fluid flow system having a first fluid conduit and a second fluid conduit, a coupling for connecting the conduits in fluid communication comprising:

a male threaded portion on the first conduit;

a female threaded portion on the second conduit, the male and female portions having cooperating threads for mated engagement along an axis of coupling rotation, and the male and female portions formed so that, by relative conduit rotation of less than 360° in a first direction about the rotation axis, the first and second conduits are affirmative connected;

a first detent element spaced radially from its respective threaded portion and extending in an axial direction on one of the conduits;

a second detent element on the other one of the conduits, the second detent element aligned for seated engagement with the first detent element when the conduits are threadably connected, whereby the seated engagement of the first and second detent elements releasably locks the first and second conduits together;

a first electrical contact on the first conduit; and a second electrical contact on the second conduit, the first and second contacts being brought into electrically conductive contact when the first and second detent elements are placed in seated engagement.

34. A filter cartridge for a powered air-purifying respirator (PAPR) system wherein the filter cartridge is removably mounted on a housing, the filter cartridge comprising:

a cartridge cannister having a filter media chamber therein, a fluid inlet in communication with the filter media chamber and a fluid outlet in communication with the filter media chamber, a threaded section associated with the fluid outlet on the cartridge cannister, the threaded section bearing threads adapted to mate with a threaded portion on the housing so that, with less than one rotation of the threaded section relative to the threaded portion, the fluid outlet of the cartridge cannister is sealably secured to the housing; and a first detent element on the cartridge cannister, spaced radially from the threaded section and extending axially therealong, with the first detent element aligned to fit into seated engagement with an opposed second detent element on the housing when the fluid outlet of the cartridge cannister is sealably secured to the housing.

35. The filter cartridge of claim 34 wherein the threaded section has highly pitched threads thereon.

36. The filter cartridge of claim 34, and further comprising:

means for detecting when the first detent element of the cartridge cannister is in seated engagement with the second detent element of the housing.

37. The filter cartridge of claim 34, and further comprising:

a user-detectible indicator which is activated when the first detent element of the cartridge cannister is in seated engagement with the second detent element of the housing.

38. The filter cartridge of claim 34 wherein the cartridge cannister has a radially extending portion bearing the first detent element thereon, the radially extending portion being circular and surrounding the fluid outlet and its associated threaded section, and further comprising:

another first detent element on the radially extending portion, aligned on an opposite side of the fluid outlet relative to the initial first detent element and aligned to fit into seated engagement with another opposed second detent element on the housing when the fluid outlet of the cartridge cannister is sealably secured to the housing.

* * * * *

UNITED STATES PATENT AND TRADEMARK OFFICE

CERTIFICATE OF CORRECTION

PATENT NO. : 6,575,165 B1
DATED : June 10, 2003
INVENTOR(S) : Cook, David D.

It is certified that error appears in the above-identified patent and that said Letters Patent is hereby corrected as shown below:

Column 10,
Lines 60-64, delete the claim and replace with

24. A method for connecting a first component onto a second component for fluid transfer therebetween in a powered air-purifying respirator (PAPR) system, the method comprising:

axially aligning a fluid outlet on the first component with a fluid inlet on the second component;

coupling the fluid outlet and the fluid inlet by less than a full rotation of the first component relative to the second component to sealably connect the fluid outlet and the fluid inlet in fluid communication;

releasably locking the first component to the second component by seated engagement, when the fluid outlet and the fluid inlet are sealably connected, of a pair of opposed detent elements on the first component and the second component; and detecting whether the fluid outlet is sealably connected to the fluid inlet in fluid communication, wherein the detecting step comprises:

altering the conductivity of an electrically conductive circuit when the opposed detent elements are in seated engagement.

Line 65, delete “fluid flow” and replace with -- powered air-purifying respirator (PAPR) system --.

Signed and Sealed this

Tenth Day of February, 2004

JON W. DUDAS
*Acting Director of the United States Patent and Trademark Office*